US009174104B1

(12) United States Patent
Rogacki

(10) Patent No.: US 9,174,104 B1
(45) Date of Patent: Nov. 3, 2015

(54) INTERCHANGEABLE GOLF GRIP SYSTEM

(71) Applicant: Edward Rogacki, Cooper City, FL (US)

(72) Inventor: Edward Rogacki, Cooper City, FL (US)

( * ) Notice: Subject to any disclaimer, the term of this patent is extended or adjusted under 35 U.S.C. 154(b) by 0 days.

(21) Appl. No.: 14/253,267

(22) Filed: Apr. 15, 2014

Related U.S. Application Data

(60) Provisional application No. 61/927,567, filed on Jan. 15, 2014, provisional application No. 61/833,745, filed on Jun. 11, 2013.

(51) Int. Cl.
*A63B 53/16* (2006.01)

(52) U.S. Cl.
CPC ..... *A63B 53/16* (2013.01)

(58) Field of Classification Search
CPC ..... A63B 53/16
USPC ..... 473/298, 299, 300, 313, 540, 549, 568
See application file for complete search history.

(56) References Cited

U.S. PATENT DOCUMENTS

| | | | | | |
|---|---|---|---|---|---|
| 1,634,082 | A * | 6/1927 | Rigby | 473/299 |
| 1,634,887 | A * | 7/1927 | Rigby | 473/299 |
| 3,070,370 | A * | 12/1962 | Steiner | 473/295 |
| 5,034,082 | A * | 7/1991 | Nolan | 156/245 |
| 5,263,275 | A * | 11/1993 | Rumbaugh | 43/23 |
| 5,288,359 | A * | 2/1994 | Stobbie et al. | 156/294 |
| 5,429,703 | A * | 7/1995 | Hartman et al. | 156/294 |
| 5,478,074 | A * | 12/1995 | Storper | 473/299 |
| 5,653,643 | A * | 8/1997 | Falone et al. | 473/300 |
| 5,730,662 | A * | 3/1998 | Rens | 473/300 |
| 5,944,617 | A * | 8/1999 | Falone et al. | 473/300 |
| 7,458,902 | B2 * | 12/2008 | Gill | 473/299 |
| 8,313,392 | B2 * | 11/2012 | White | 473/316 |
| 8,491,408 | B2 * | 7/2013 | Beach et al. | 473/296 |
| 2002/0077191 | A1 * | 6/2002 | Roelke | 473/300 |
| 2002/0107088 | A1 * | 8/2002 | Lamkin et al. | 473/300 |
| 2008/0227562 | A1 * | 9/2008 | Gill | 473/299 |
| 2009/0062030 | A1 * | 3/2009 | Gill | 473/288 |
| 2011/0053704 | A1 * | 3/2011 | Huang | 473/300 |
| 2014/0342845 | A1 * | 11/2014 | Dingman | 473/297 |

* cited by examiner

*Primary Examiner* — William Pierce
(74) *Attorney, Agent, or Firm* — Mark D. Bowen; Malin Haley DiMaggio & Bowen, P.A.

(57) ABSTRACT

An interchangeable grip system for golf putters includes an inner sleeve installed on the butt end of a putter shaft, and a plurality of pre-manufactured outer grip sleeves adapted for universal removable installation on the inner sleeve. The look and/or feel of the putter may be changed by simply removing the outer sleeve and replacing it with an alternate outer sleeve. A threaded fastener secures the outer sleeve to the inner sleeve, and may further function to permit weight adjustment. A plurality of weighted fasteners is provided to allow for the overall weight of the putter to be adjusted. Each fastener is provided with a keyed head that requires a compatible tool or wrench for tightening and removal. A hand-tool is provided to allow for quick and easy removal of the fastener, and further functions to store various weighted fasteners to allow for weight adjustment.

10 Claims, 13 Drawing Sheets

INTERCHANGEABLE GOLF GRIP SYSTEM

CROSS REFERENCE TO RELATED APPLICATIONS

This application claims the benefit of provisional U.S. Patent Application Ser. No. 61/927,567, filed on Jan. 15, 2014, and provisional U.S. Patent Application Ser. No. 61/833,745, filed on Jun. 11, 2013.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The present invention relates to golf equipment, and more particularly to an interchangeable putter grip system.

2. Description of Related Art

Golf has experienced a significant increase in popularity in recent years which has driven demand for a number of advances and innovations in golf club design. One golf club, however, has been the subject of more innovative efforts than the others, that golf club is the putter. One reason why the putter has been the subject of so much innovation efforts is that its use can account for over half of the strokes allotted for a regulation round at par. Simply put, in a typical round of golf, the putter is used more often than any other club in the bag. Golf courses are typically designed for a "par" score of 72, with layouts that allow for two putts per hole, or 36 putts per round. Thus, a golfer shooting a "par" score of 72 may use his/her putter for half of the shots.

As a result, golfers are known to have strong preferences as to the putter's look and feel, and often desire to modify certain characteristics. For example, it is not uncommon for a golfer to change the putter's grip, weighting, and even appearance in an effort to improve putting performance. Further, some golfers desire to adjust the feel of the putter depending on the conditions of the green, the type of grass, degree of undulations, speed of the green, etc. Other times, the golfer may simply wish to tailor the look of the putter by altering the color or appearance of the grip.

Conventional golf putter grips are affixed to the putter by a process that involves the application of grip tape and solvent to adhesively secure the grip to the putter shaft. Removal of the grip typically requires slicing the grip with a sharp blade and peeling the grip off of the shaft, a time consuming process that destroys the grip. Grip removal and replacement typically requires sending the putter to the "shop" or seeking the assistance of a golf equipment technician.

Accordingly, there exists a need for advancements in the art of golf putters to allow for quick and easy modification of the golf putter. There further exists a need for an interchangeable grip system for golf putters to allow for customized modification.

BRIEF SUMMARY OF THE INVENTION

The present invention overcomes the limitations and shortcomings in the art by providing an interchangeable grip system for golf putters that allows for quick and easy grip changes using a variety of interchangeable pre-manufactured grips. An interchangeable grip system in accordance with the present invention includes an inner sleeve installed on the butt end of a putter shaft, and a plurality of pre-manufactured outer grip sleeves adapted for universal removable installation on the inner sleeve. The golfer thus has the option of changing the look and/or feel of the putter by simply removing the outer sleeve and replacing it with an alternate outer sleeve. A threaded fastener secures the outer sleeve to the inner sleeve, and may further function to permit weight adjustment. A plurality of weighted fasteners is provided to allow for the overall weight of the putter to be adjusted. Each fastener is provided with a keyed head that requires a compatible tool or wrench for tightening and removal. A handtool is provided to allow for quick and easy removal of the fastener, and further functions to store various weighted fasteners to allow for weight adjustment. The outer grip sleeve may be wrapped with any of a variety of materials, including natural or synthetic materials fabricated with specific color schemes and patterns thereby allowing the user to customize his/her putter. The interchangeable grip system of the present invention complies with the Rules relating to the design and manufacture of golf clubs established by the United States Golf Association ("USGA").

Accordingly, it is an object of the present invention to provide advancements in the art of golf equipment.

Another object of the present invention is to provide a system of interchangeable grips for golf clubs, particularly putters.

Still another object of the present invention is to provide an interchangeable grip system that allows the user to quickly and easily change the look and or feel of the grip while remaining in conformance with the USGA rules relating to the design and manufacture of golf clubs.

DETAILED DESCRIPTION OF THE INVENTION

The present invention may be understood more readily by reference to the following detailed description taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
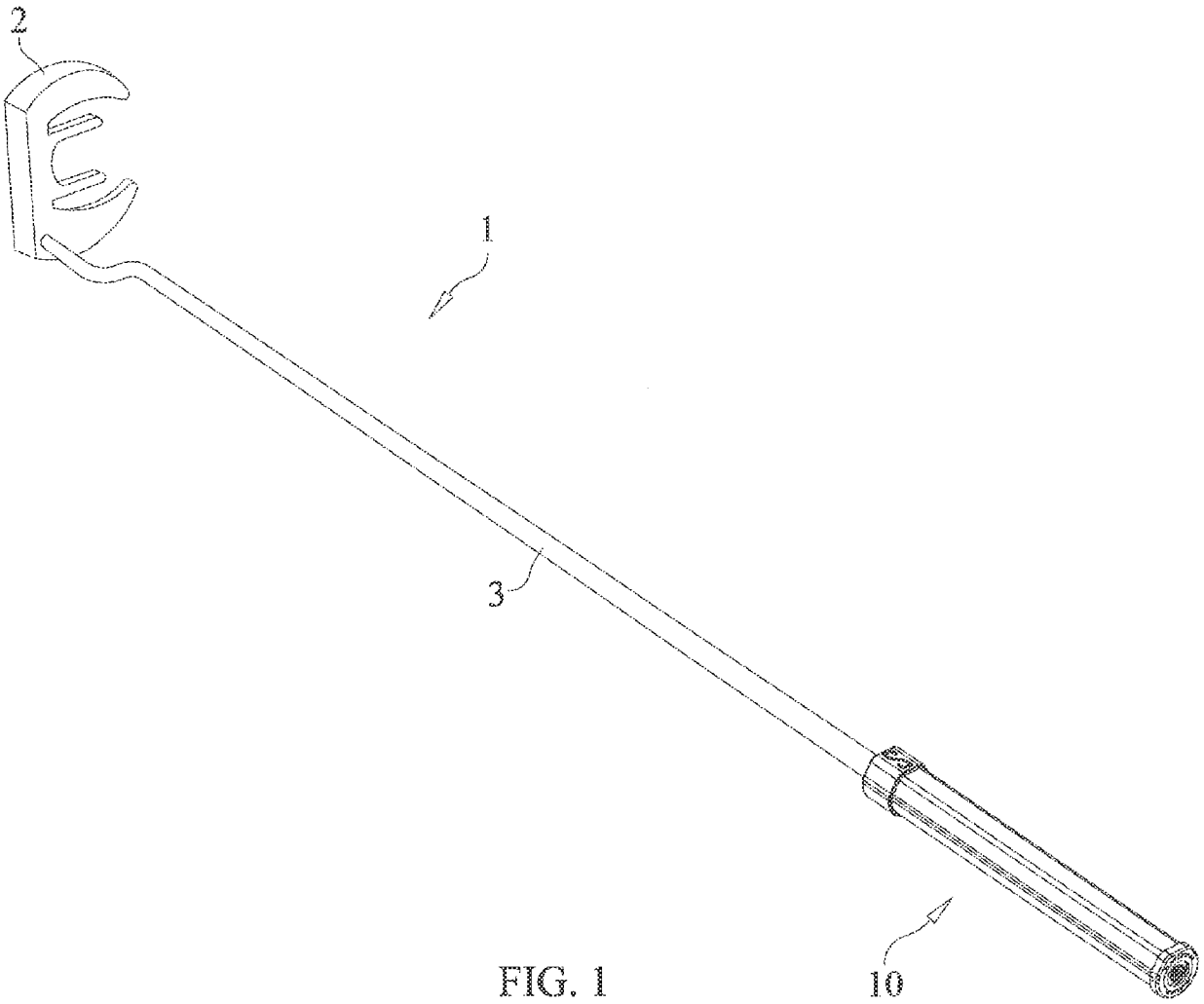
FIG. 1 is a perspective view of a golf putter equipped with an interchangeable grip system in accordance with the present invention.
Figure 2:
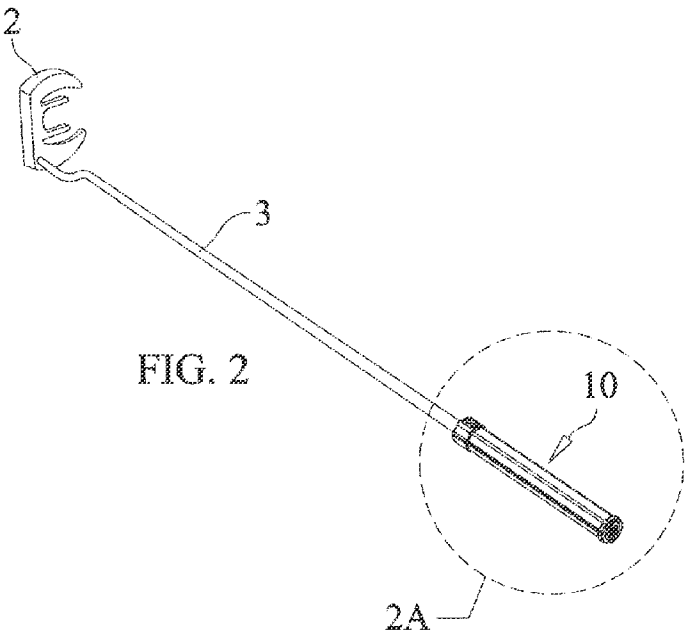
FIG. 2 is a perspective view of a golf putter equipped with an interchangeable grip in accordance with the present invention.
Figure 2A:
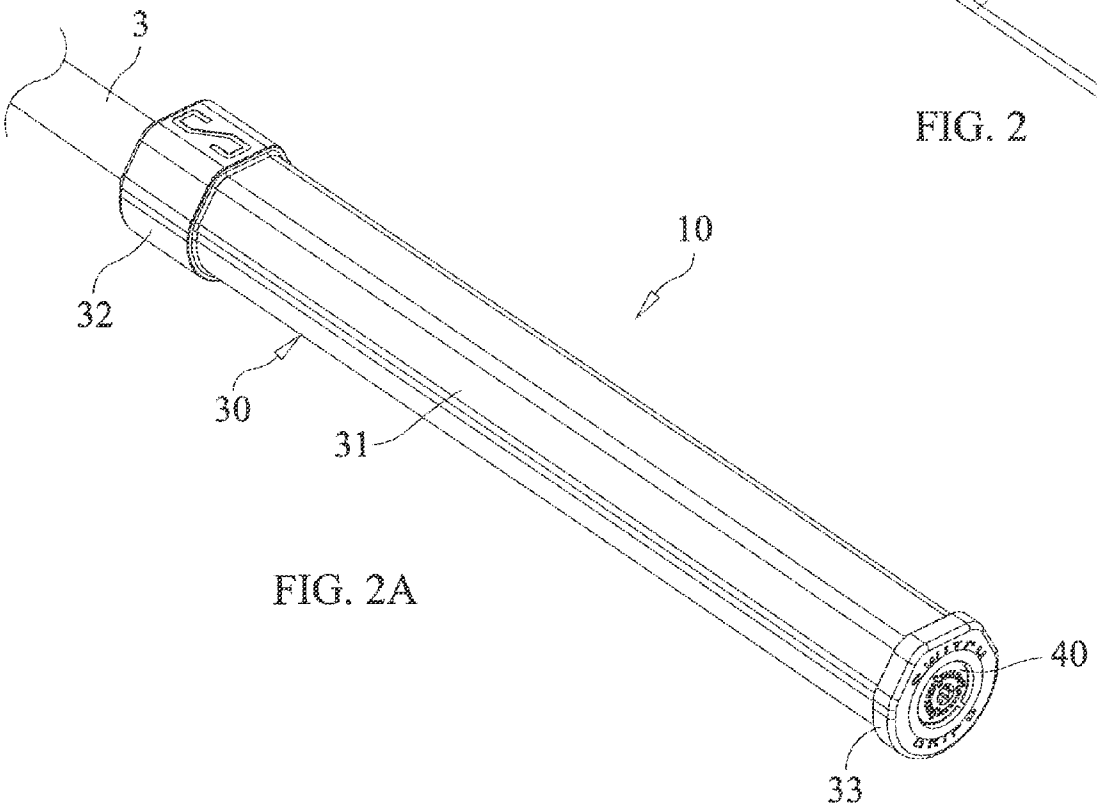
FIG. 2A is a detailed view thereof.
Figure 12:
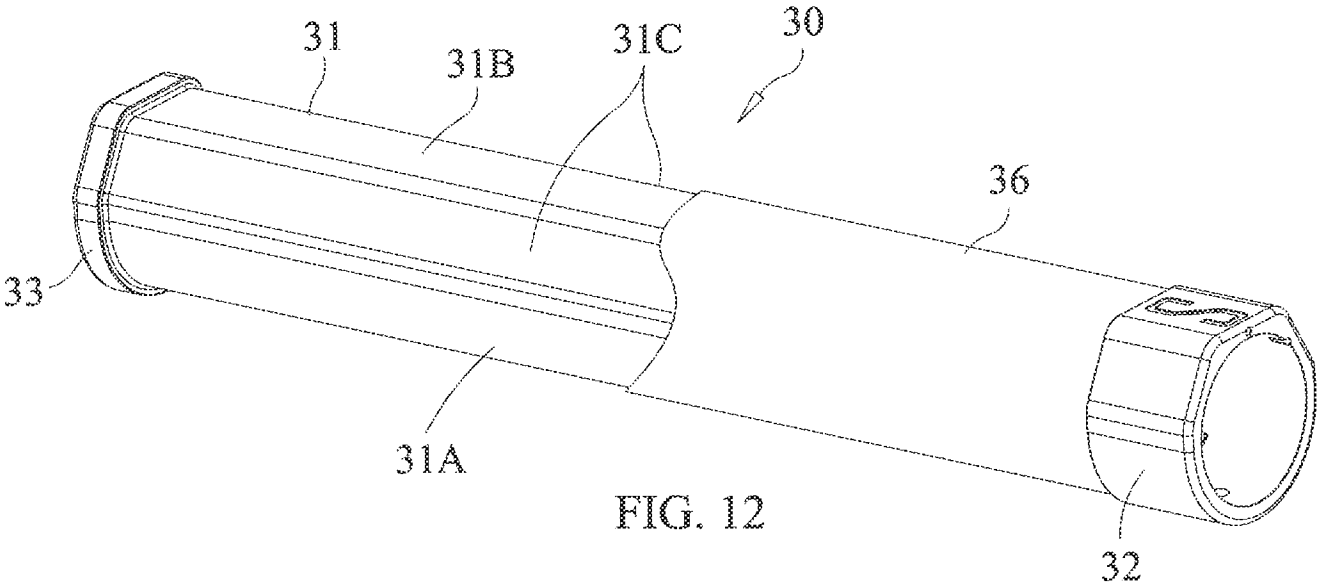
FIG. 12 is a perspective view of the outer sleeve component.

Turning now to the drawings, FIGS. 1-22 depict a preferred embodiment of an interchangeable putter grip system, generally referenced as 10, in accordance with the present invention. Grip system 10 is illustrated as being installed on a typical golf putter, generally referenced as 1, which includes a putter head 2 and a shaft 3. FIGS. 2 and 2A provide a detailed view of grip system 10 installed on putter 1, and particularly reveal the outer sleeve member, generally referenced as 30, including a main body 31, a bottom cover 32 and a top cover 33. FIG. 12 depicts grip material 36 (shown in partial view) disposed on main body 30. Grip material 36 may comprise any suitable material such as such as leather, rubberized material, or natural or synthetic grip material. Grip material may comprise the form of a wrap, a sleeve, or any other suitable structure.

Figure 3:
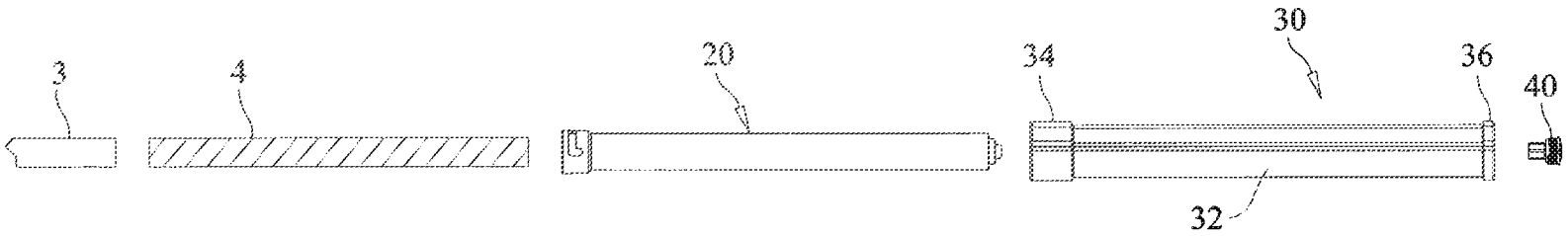
FIG. 3 is an exploded side view of an interchangeable golf club system in accordance with the present invention.
Figure 4:
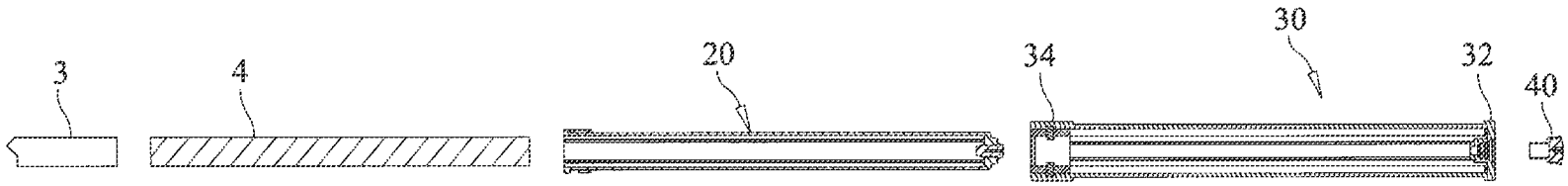
FIG. 4. is an exploded side sectional view thereof.
Figure 7:
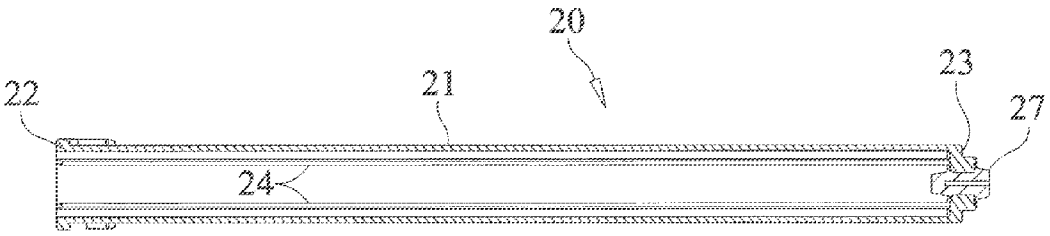
FIG. 7 is a side sectional view of the inner sleeve taken along line 6-6 of FIG. 5.
Figure 6:
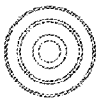
FIG. 6 is a bottom end view thereof.
Figure 5:
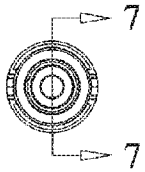
FIG. 5 is a top end view of the inner sleeve.
Figure 8:
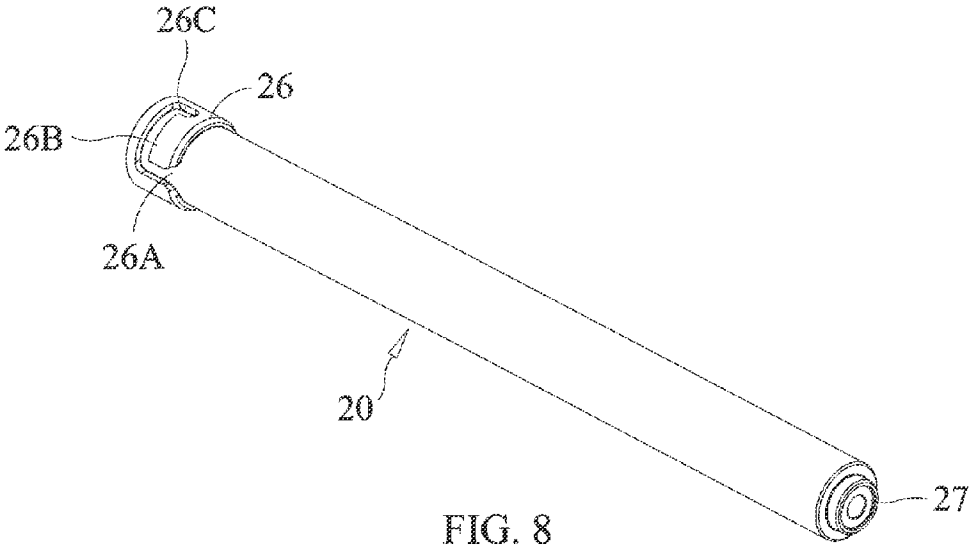
FIG. 8 is a perspective view of the inner sleeve component.
Figure 10:
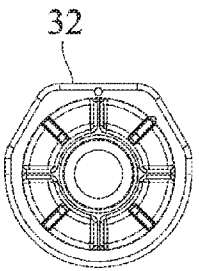
FIG. 10 is a bottom end view thereof.

FIGS. 3 and 4 provide exploded illustrations of the interchangeable putter grip system 10 in accordance with the present invention. A butt end of the putter shaft 3 receives a suitable number of wraps of grip tape 4 to build up the outer diameter of the putter shaft to a sufficient degree to receive an inner sleeve, generally referenced as 20 inserted thereon. Grip tape 4 may comprise double sided tape, solvent activated golf grip tape, or any other suitable adhesive material or substance. Inner sleeve 20 is then slidably installed onto the butt end of the shaft 3 so as to become generally permanently affixed to the putter shaft. It should be noted, however, that inner sleeve 20 may be removed and transferred to another putter shaft if desired. Once inner sleeve 20 is installed, outer sleeve 30 is installed by receiving inner sleeve 20 concentrically disposed therein. A screw-in weight 40 is axially inserted through the top end of outer sleeve 30 and placed in threaded engagement with a threaded aperture formed in the top end thereof thereby fixing the outer sleeve 30 relative to the inner sleeve 20.

With reference to FIGS. 5-8, there are provided detailed illustrations of inner sleeve 20. Inner sleeve 20 comprises a generally tubular structure which is preferably fabricated from suitable injection molded plastic, however, any suitable material may be used. Inner sleeve 20 includes a generally tubular main sleeve body 21 having a generally open bottom end 22 and a top end 23. Main body 22 defines a shaft receiving inner chamber bounded by an inner surface. A plurality of longitudinal radially inwardly projecting ribs 24 extend from said inner surface. Ribs 24 function as inner sleeve 20 is slid over the putter shaft to locally displace or dig into the grip tape 4 thereby anchoring sleeve 20 relative to putter shaft 3. It should be noted at this juncture that inner sleeve 20 may function as a golf putter grip without use of outer sleeve 30. Bottom end 22 includes a radially enlarged collar 25 defining a recessed groove 26 which includes a longitudinal inlet 26A, a circumferential extension 26B extending from inlet 26A, and a bayonet detent 26C which functions to lock in outer sleeve 30 as more fully discussed herein. Collar 25 may be integrally formed with sleeve 20, or alternately formed by affixation of a separate annular member. The top end 23 of inner sleeve 20 includes an axially disposed centering projection or bumper 27 which functions to ensure that, upon installation, outer sleeve 30 is concentrically disposed about inner sleeve 20.

Figure 9:
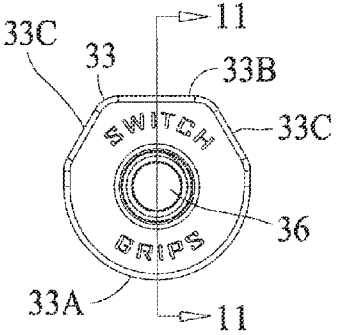
FIG. 9 is a top end view of the outer sleeve.
Figure 11:
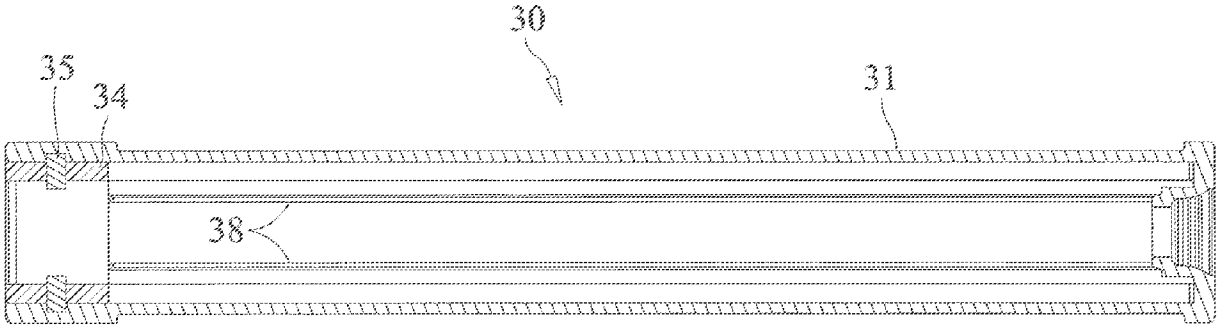
FIG. 11 is a sectional view of the outer sleeve taken along line 11-11 of FIG. 9.

FIGS. 9-12 provide various detailed illustrations of outer sleeve 30 which functions as the grip. Outer sleeve 30 comprises a generally tubular rigid structure which is preferably fabricated from suitable injection molded plastic; however, any suitable material may be used. Outer sleeve 30 further includes a bottom end cap 32 and a top end cap 33. End caps 32 and 33 are preferably separate attachable members, however, forming end caps 32 and 33 integrally with outer sleeve 30. At least outer sleeve 30, and preferably bottom cap 32 and top cap 33, define an irregular outer surface which allows for an enhanced ergonomic putting grip. With reference to the end view of top cap 33 as seen in FIG. 9, the irregular outer surfaces include an arcuate rear segment 33A, a generally planar front segment 33B with planar lateral segments, each referenced 33C, connecting the front and rear segments. The outer surface 31 of outer sleeve 30 has corresponding segments as best illustrated in FIG. 12 wherein actuate rear surface segment 31A, planar top surface segment 31B, and one of the planar lateral segments 31C are seen. Bottom end cap 32 conceals a bayonet pin ring 34 having a pair of bayonet pins 35 projecting radially inward therefrom. Bayonet pins 35 are received within recessed groove 26 on inner sleeve 20 and function to retain outer sleeve 30 relative to inner sleeve 20. Top end cap 33 defines an internally threaded aperture 36 for receiving an externally threaded weight 40 as more fully discussed below. Finally, the interior of sleeve 30 defines a chamber for receiving the inner sleeve inserted therein, and a plurality of longitudinal radially inwardly projecting ribs 38 project from the inner surface of sleeve 30. Ribs 38 function to engage the outer surface of inner sleeve 20 to align and center the outer sleeve upon installation.

Figures 13A, 13B, 13C, 13D, 13E:
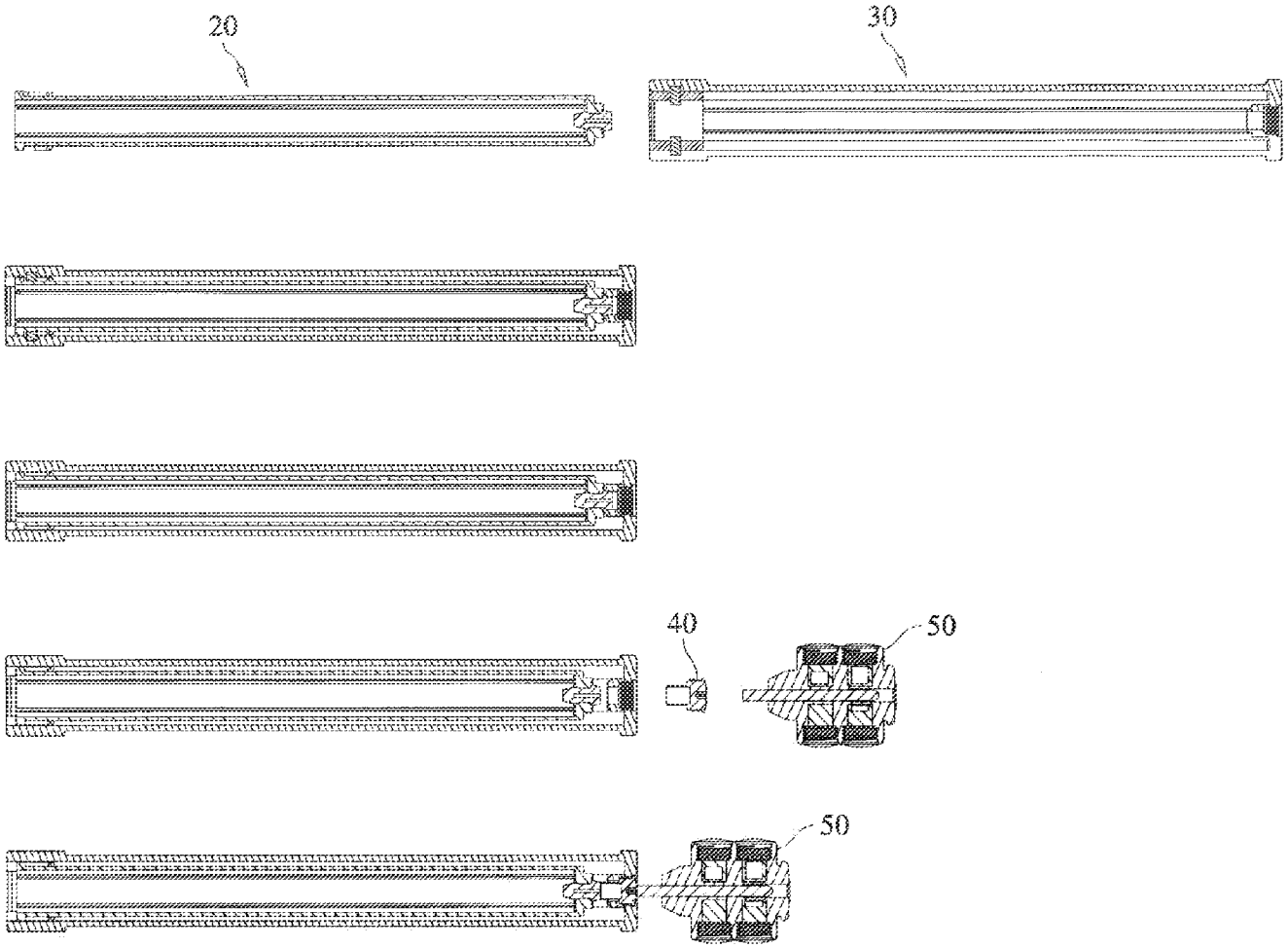
FIGS. 13A-13E are exploded illustrations showing installation of the outer sleeve on the inner sleeve.

FIGS. 13A-13E illustrate mating engagement of outer sleeve 30 with inner sleeve 20 with the putter shaft omitted for the purpose of this illustration. Outer sleeve 30 is positioned to slide onto inner sleeve 20 as illustrated in FIG. 13A. Next, outer sleeve 30 is slidably installed concentric, axially aligned relation with inner sleeve 20 as illustrated in FIG. 13, whereby bayonet pins 34 are received within bayonet groove 26 through inlet 26A. A small axial force is applied such that bayonet pins 35 reach the end of grove inlet 26A at circumferential groove extension 26B. As illustrated in FIG. 13C, the outer sleeve is then rotated approximately a quarter-turn whereby bayonet pins 35 travel along circumferential groove extension 26B to detent 26C. Next a screw 40 (which may be weighted) is inserted within internally threaded aperture 36 in top end cap 33 and tightened using a hand tool 50 thereby ensuring that the outer sleeve assembly is precisely centered relative to inner sleeve 20 and fixed relative thereto.

Figure 14:
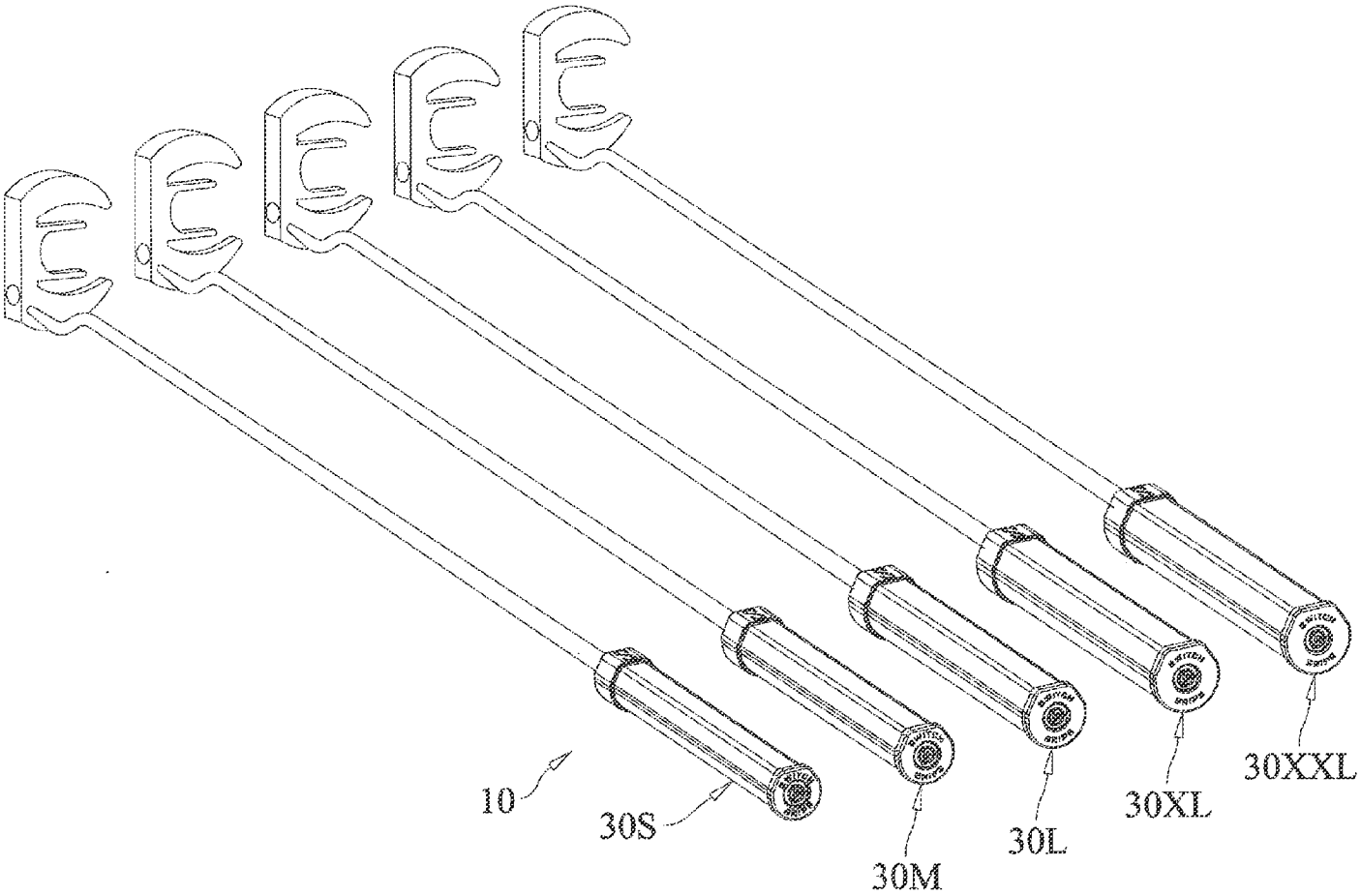
FIG. 14 is a perspective view of golf putters illustrating various grip sizes installed thereon.
Figures 15A, 15B, 15C, 15D, 15E:
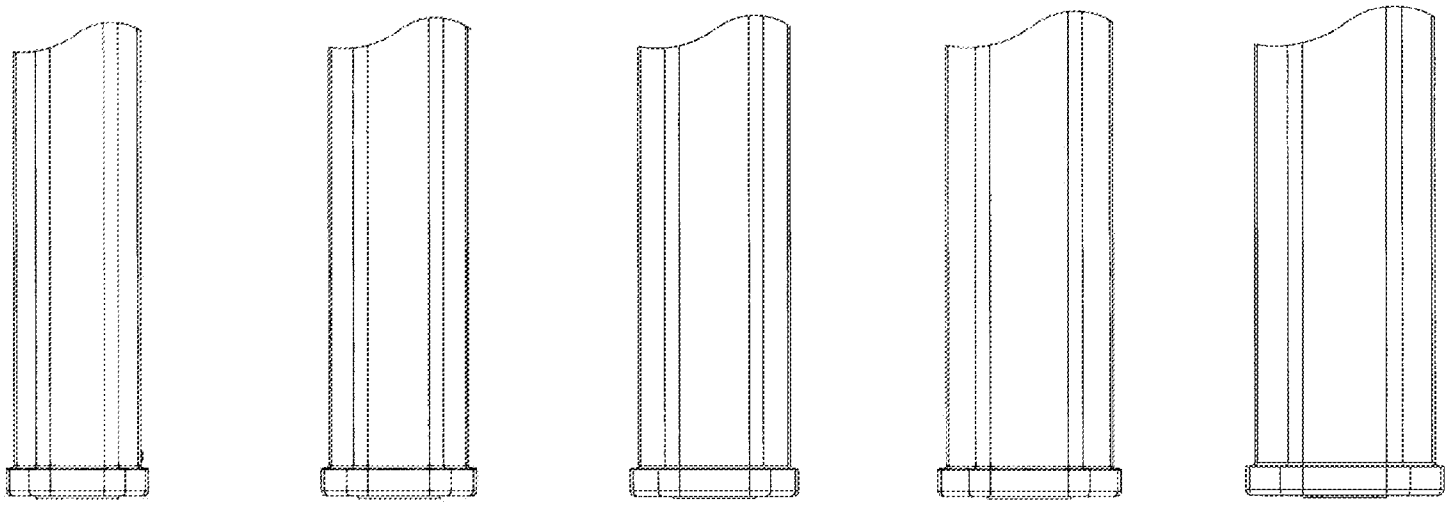
FIGS. 15A-15E illustrate various grip sizes for interchangeable grips in accordance with the present invention.
Figure 17:
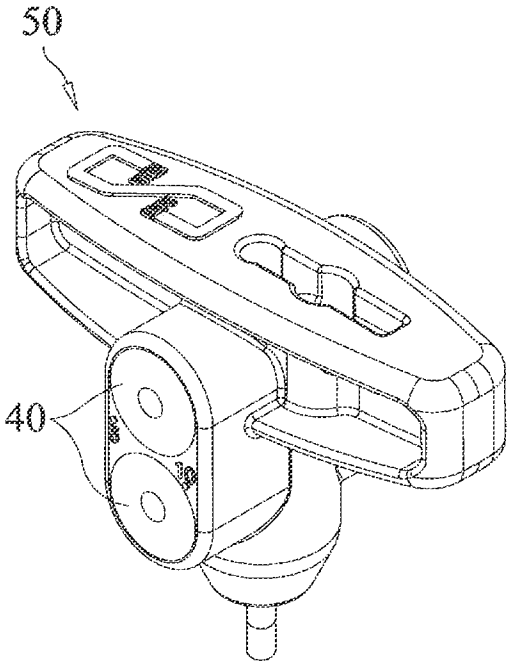
FIG. 17 is a side sectional view thereof taken along line 17-17 of FIG. 16.
Figure 16:
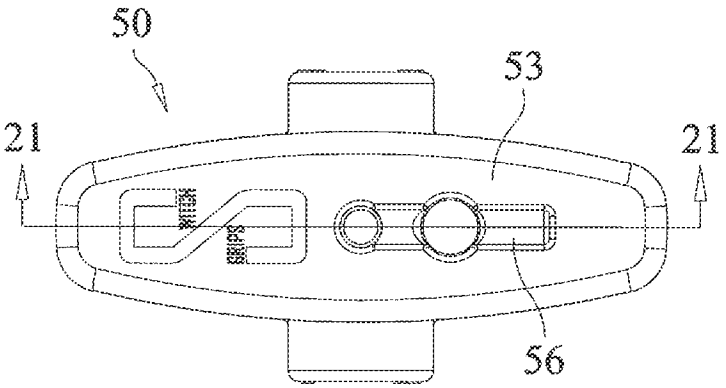
FIG. 16 is a top view of a hand tool assembly for tightening and loosening grip weights in accordance with the present invention.
Figure 19:
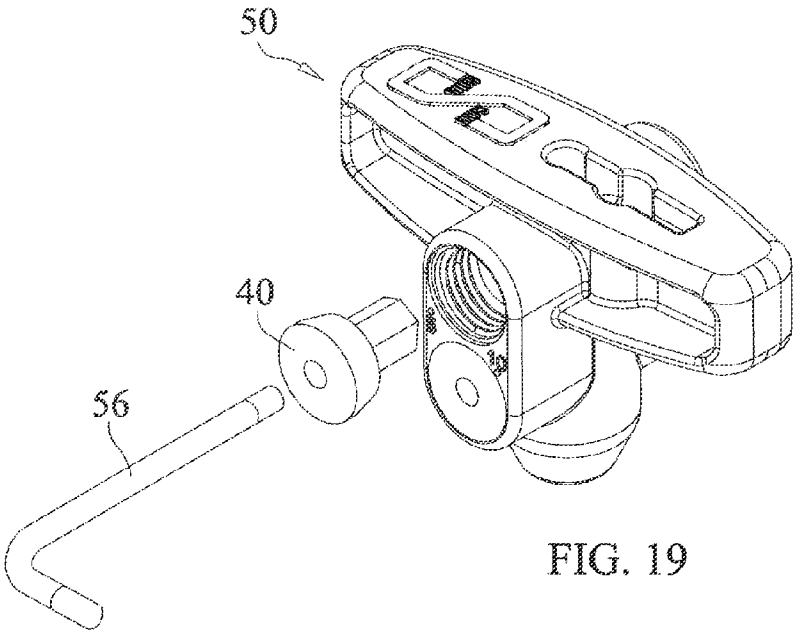
FIG. 19 is a top perspective view thereof.
Figure 18:
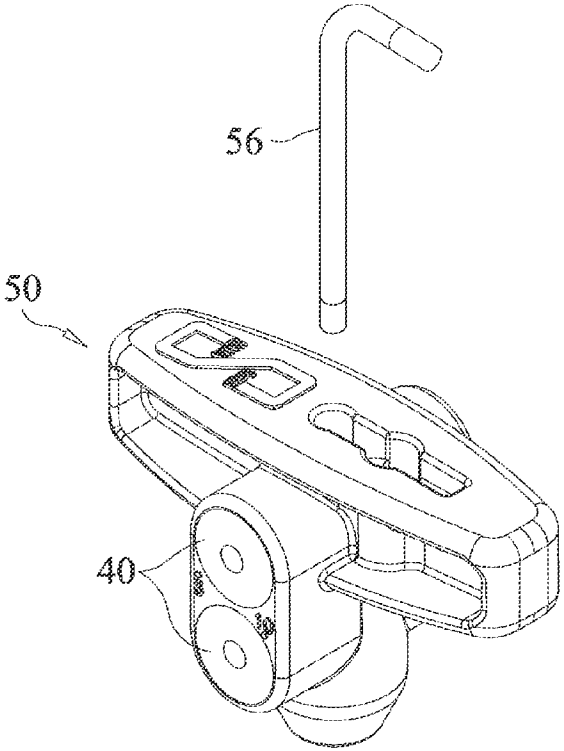
FIG. 18 is a side view thereof.
Figure 21:
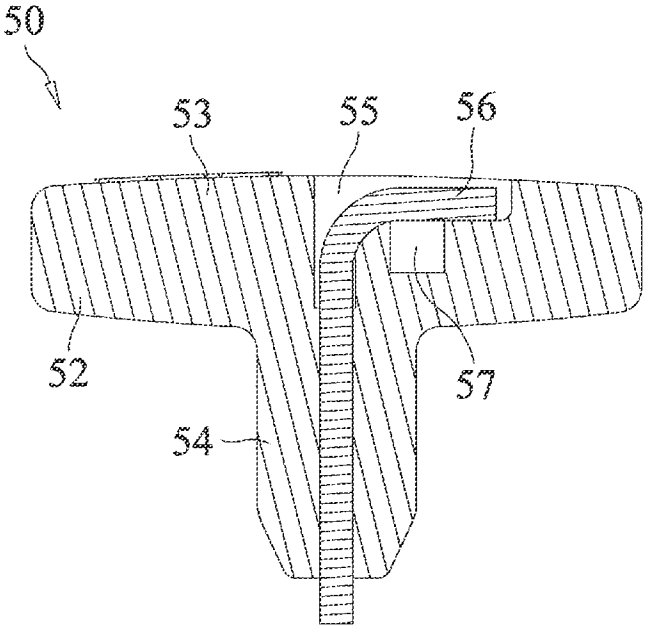
FIG. 21 is an exploded top perspective view thereof illustrating use of the tightening tool to remove stored weights from the handle.
Figure 20:
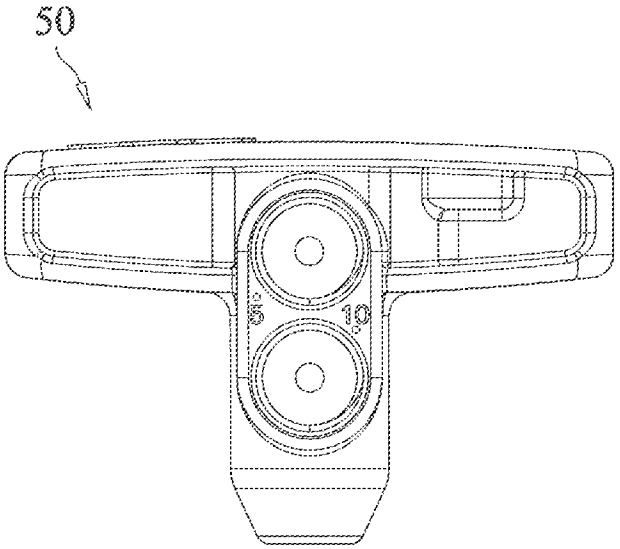
FIG. 20 is an exploded top perspective view thereof illustrating removal of the tightening tool removed from its stowed configuration.

As best illustrated in FIGS. 14 and 15A-15E, the interchangeable grip assembly of the present invention allows the user to quickly and easily install various grips. FIG. 14 illustrates a putter having grips of varying sizes, namely small 30S, medium 30M, large 30L, X-large 30XL, and XX-large 30XXL. As noted above, the grips may be adapted with logos or other indicia molded, stamped, printed, or embossed on or into the grip material. FIG. 15A-15E provide further illustrations of various grip sizes with end views illustrating the screw-in weights, referenced as 40A-40E. Weights 40A-40E may vary in mass as further discussed below thereby allowing the user to add or subtract weight from the putter. Each weight 40 defines an axial keyed recess which receives the mating end of tool 50.

Figure 22:
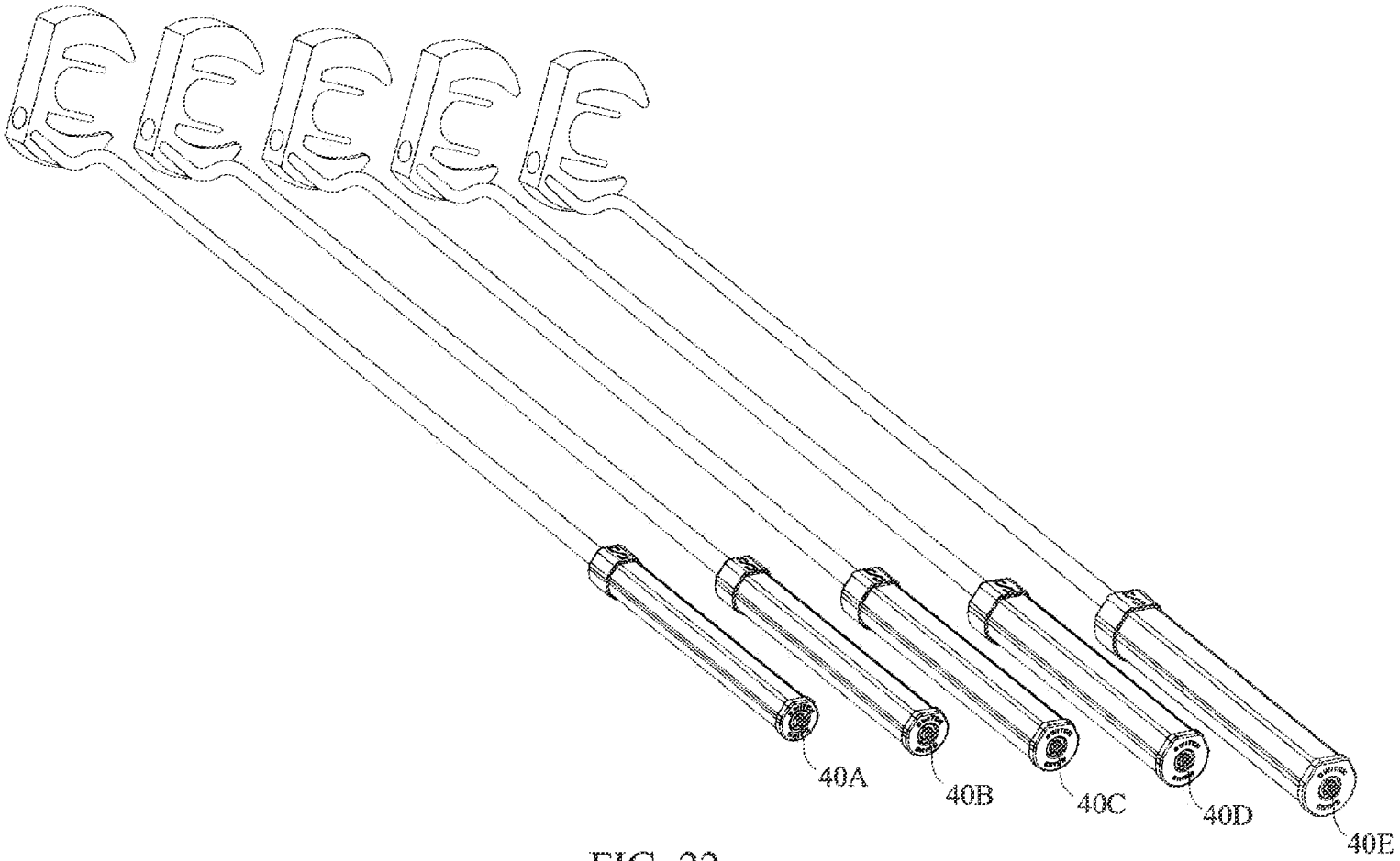
FIG. 22 illustrates various screw-in handle weights in accordance with the present invention.

FIGS. 16-21 illustrate a hand tool, generally referenced as 50, for use in installing and removing outer sleeve 30 from inner sleeve 20 in accordance with the present invention. Hand tool 50 includes a generally T-shaped main body 52 having an upper portion 53 and a lower portion 54. Main body 52 defines a generally inverted L-shaped through bore 55 which terminates at an axial opening in the bottom of main body 52. Through bore 55 receives a generally L-shaped wrench 56 having an end defining a male TORX® head. TORX® is a trademark for a type of screw head characterized by a 6-point star pattern. In addition, both opposing ends of wrench 56 may be adapted with the TORX® head. Wrench 56 is employed in installing and removing screw-in weights 40, which are each also adapted with a female TORX® head. While the preferred embodiment of the present invention, and particularly wrench 56 and screw-in weights 40 are disclosed as incorporating the TORX technology, any suitable threaded fastener and wrench configuration are considered within the scope of the present invention. A magnet 57 is affixed to main body 52 within aperture 55 and functions to maintain wrench 56 removably magnetically attached thereto. The main body 52 of tool 50 is further adapted with female threaded apertures which function to removably receive a screw-in weights 40 as best illustrated in FIGS. 18-21. By simply removing wrench 56 from main body 50, the user is able to remove one of the four screen-in weights stored on the tool body to alter the weight of the putter as illustrated in FIG. 22. As noted above, weights 40A 40E are provided with varying mass including a weight increments that range from a 0-gram screw in weight 40A, 5-gram screw-in weight 40B, 10-gram screw-in weight 40C, 15-gram screw in weight 40D, and a 20-gram screw-in weight 40E. Each weight preferably includes an indicator that informs the user exactly how much the weight weighs.

While the present invention has been disclosed in its preferred embodiment as an interchangeable grip system for golf putters, the advances discloses herein may be adapted for use on other golf clubs, such as irons, metal woods, and drivers. In addition, the system interchangeable grip system herein may further be adapted for use with a wide variety of goods having grips, including without limitation, billiard/pool cue sticks, lacrosse sticks, tennis racquets, etc. Finally, the interchangeable grip system is further suitable for use with non-sports related goods, such as umbrellas.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An interchangeable golf grip system for use with a golf club having a shaft, said system comprising:

a generally tubular inner sleeve having a top end and an open bottom end, said sleeve defining a shaft receiving inner chamber;

an outer sleeve forming a grip, said outer sleeve having a top end and an open bottom end, said outer sleeve defining an inner sleeve receiving chamber;

said inner sleeve defining a recessed groove, and a said outer sleeve including at least one pin engaging said groove;

an axially disposed centering projection projecting from the top end of said inner sleeve, an axial threaded aperture defined in the top end of said outer sleeve, and a fastener in threaded engagement with said threaded aperture, said fastener having a bottom end engaging said centering projection to fix said pin within said groove and maintain said outer sleeve fixed relative to said inner sleeve; and whereby said outer sleeve is removably attachable to said inner sleeve.

2. The interchangeable golf grip system according to claim 1, wherein said inner sleeve includes a plurality of ribs projecting radially inward within said inner chamber, said ribs functioning to engage grip tape on the putter shaft to anchor said inner sleeve.

3. The interchangeable golf grip system according to claim 1, wherein said outer sleeve includes a plurality of ribs projecting radially inward within said inner sleeve receiving chamber, said ribs functioning to axially align said outer sleeve.

4. The interchangeable golf grip system according to claim 1, wherein said fastener is selected from a group of fasteners having various weights.

5. The interchangeable golf grip system according to claim 1, further including a plurality of interchangeable outer sleeves each adapted for removable installation on said inner sleeve.

6. An interchangeable golf grip system for use with a golf putter having a shaft, said system comprising:

a generally tubular inner sleeve having a top end and an open bottom end, said sleeve defining a shaft receiving inner chamber;

said collar defining a recessed groove, said groove originating at an inlet and terminating at a bayonet detent;

an outer sleeve forming a grip, said outer sleeve having an open bottom end and a top end, said outer sleeve defining an inner sleeve receiving chamber, and an outer surface;

grip material disposed on the outer surface of said outer sleeve;

said outer sleeve including a radially inwardly projecting pin disposed in proximity to the bottom end thereof;

said pin engaging said groove when said outer sleeve is affixed to said inner sleeve; and an axial threaded aperture defined in the top end of said outer sleeve, and a fastener in threaded engagement with said threaded aperture, said fastener having a bottom end engaging the top end of said inner sleeve and maintaining said pin securely within said bayonet detent whereby said outer sleeve is fixedly secured relative to said inner sleeve.

7. The interchangeable golf grip system according to claim 6, wherein said inner sleeve includes a plurality of ribs projecting radially inward within said inner chamber, said ribs functioning to engage grip tape on the putter shaft to anchor said inner sleeve.

8. The interchangeable golf grip system according to claim 6, wherein said outer sleeve includes a plurality of ribs projecting radially inward within said inner sleeve receiving chamber, said ribs functioning to axially align said outer sleeve.

9. The interchangeable golf grip system according to claim 6, wherein said fastener is selected from a group of fasteners having various weights.

10. The interchangeable golf grip system according to claim 6, further including a plurality of interchangeable outer sleeves each adapted for removable installation on said inner sleeve.

* * * * *